US005992025A

United States Patent [19]

Fricke

[11] Patent Number: 5,992,025

[45] **Date of Patent: *Nov. 30, 1999**

[54] PORTABLE HANDHELD WORK APPARATUS WITH A SAFETY MEMBER FOR ATTACHING A SAFETY ROPE

[75] Inventor: Gerd Fricke, Unterhaching, Germany

[73] Assignee: Andreas Stihl AG & Co., Waiblingen, Germany

[ * ] Notice: This patent is subject to a terminal disclaimer.

[21] Appl. No.: 08/907,412

[22] Filed: Aug. 7, 1997

[30] Foreign Application Priority Data

Aug. 9, 1996 [DE] Germany ..... 296 13 806 U

[51] Int. Cl.[6] ..... B26B 27/00

[52] U.S. Cl. ..... 30/381; 30/382; 30/298.4

[58] Field of Search ..... 30/298.4, 296.1, 30/381, 382, 383; 224/220, 254, 162; 294/82.11; 24/3.1; 16/112, 126; D8/65

[56] References Cited

U.S. PATENT DOCUMENTS

D. 325,155 4/1992 Nagashima ..... D8/65
D. 377,441 1/1997 Hoppner et al. ..... D8/65
D. 386,958 12/1997 Karlsson et al. ..... D8/65
4,563,813 1/1986 Fortenberry ..... 30/161
5,272,813 12/1993 Wolf et al. ..... 30/298.4
5,727,319 3/1998 Myerchin et al. ..... 30/123

*Primary Examiner*—M. Rachuba
*Attorney, Agent, or Firm*—Walter Ottesen

[57] ABSTRACT

The invention is directed to a portable handheld work apparatus having a motor driven work tool. The work apparatus includes a housing, a handle mounted on the housing for holding and guiding the work apparatus and a safety member having an attachment portion and a lug portion for receiving and accommodating a safety rope therethrough to facilitate holding the work apparatus. The attachment portion and the lug portion conjointly define a single piece. The attachment portion is held on the housing so as to permit the lug portion to move between a rest position wherein the lug portion is at least partially in contact engagement with the housing and an in-use position wherein the lug portion is displaced away from the housing.

18 Claims, 4 Drawing Sheets

Fig. 3
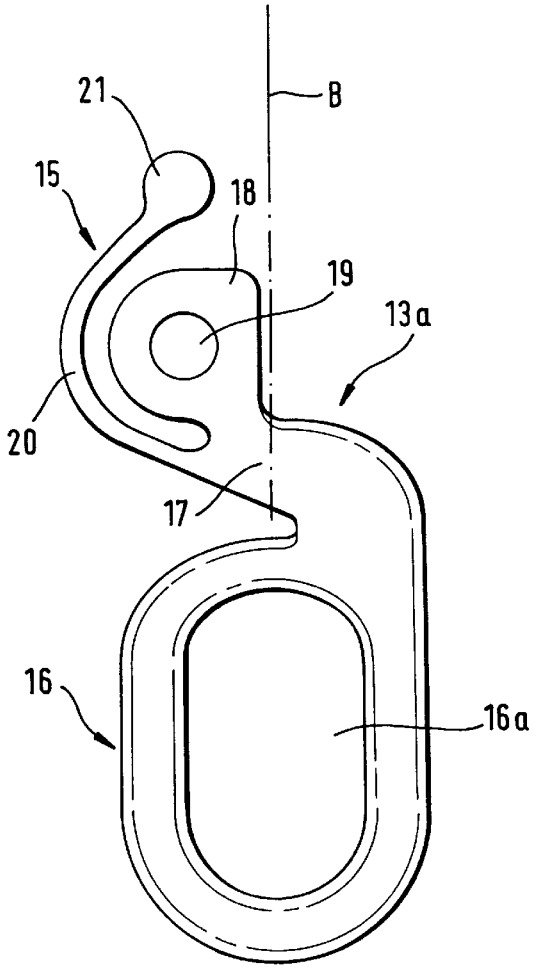
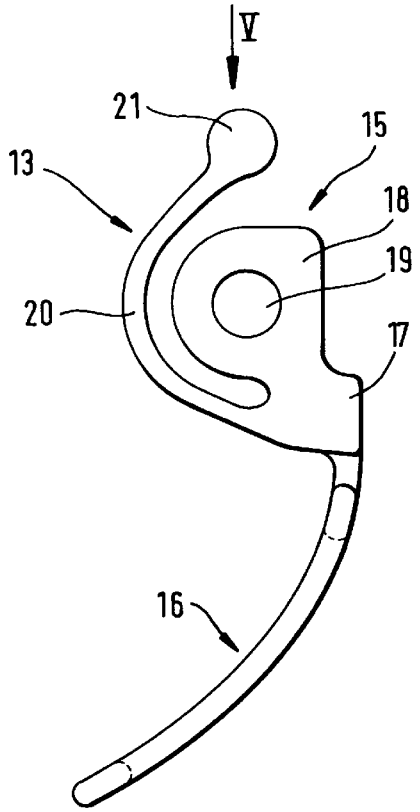
Fig. 4
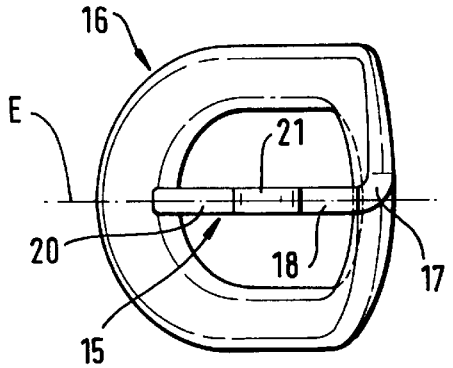
Fig. 5

PORTABLE HANDHELD WORK APPARATUS WITH A SAFETY MEMBER FOR ATTACHING A SAFETY ROPE

FIELD OF THE INVENTION

The invention relates to a handheld work apparatus having a motor-driven tool such as a motor-driven chain saw having a carrying and holding handle and a safety member for attachment of a safety rope.

BACKGROUND OF THE INVENTION

U.S. Pat. No. 5,272,813 discloses a motor-driven chain saw having a safety member. The safety member functions for connecting a safety rope or a hook attached to the rope or some other holding member in order to prevent the work apparatus from falling inadvertently to the ground. This is for specific dangerous work such as cutting limbs from trees utilizing a motor-driven chain saw. In this way, the operator can hold the apparatus first only on the rope when the operator climbs a tree or when reaching another high elevation work site. Or, the operator can hold the work apparatus only with one hand and maintain this safety measure especially for overhead work so that the apparatus will be held by the rope in the event that the operator loses hold thereof thereby preventing the apparatus from falling to the ground.

In the known work apparatus, the lug of the safety member is a bent round rod which is pivotally connected to an attachment member. The lug can therefore be pivoted into a trough-like recess of the apparatus housing when other work is performed with the motor-driven chain saw for which a safety measure utilizing a rope is unnecessary. This is purposeful for specific work for which a placement of the apparatus on a surface on the particular side of the housing is wanted where the safety member is located. In this way, a projecting lug is not a disturbance.

SUMMARY OF THE INVENTION

It is an object of the invention to simplify manufacture and assembly of the safety member while retaining the advantages of the known work apparatus equipped with a safety member.

The portable handheld work apparatus of the invention has a motor driven work tool and includes: a housing; a handle mounted on the housing for holding and guiding the work apparatus; a safety member having an attachment portion and a lug portion for receiving and accommodating a safety rope therethrough to facilitate holding the work apparatus; the attachment portion and the lug portion conjointly defining a single piece; and, means for holding the attachment portion on the housing so as to permit the lug portion to move between a rest position wherein the lug portion is at least partially in contact engagement with the housing and an in-use position wherein the lug portion is displaced away from the housing.

The one-piece configuration of the safety member makes possible the configuration as a formed flat part which is preferably a stamped part and is formed in such a manner that the lug of the safety member is bent out of the plane of the attachment portion of the safety member approximately at right angles. The safety member can be seated with its flat attachment portion in a narrow gap of the apparatus housing and be pivotally journalled in such a manner that the arcuately-shaped lug lies completely on the housing in the rest position and so that the contour of the housing is not noticeably changed. Within the housing, the attachment portion can be guided in a pivot mount and be latchable.

BRIEF DESCRIPTION OF THE DRAWINGS

The invention will now be described with reference to the drawings wherein:

FIG. 3 is a plan view of the stamped flat part before being formed into the safety member;

FIG. 4 is a plan view of the safety member after being bent along bending line B of FIG. 3;

FIG. 5 is a plan view of the safety member as seen in the direction of arrow V of FIG. 4;

DESCRIPTION OF THE PREFERRED EMBODIMENTS OF THE INVENTION

Figure 1:
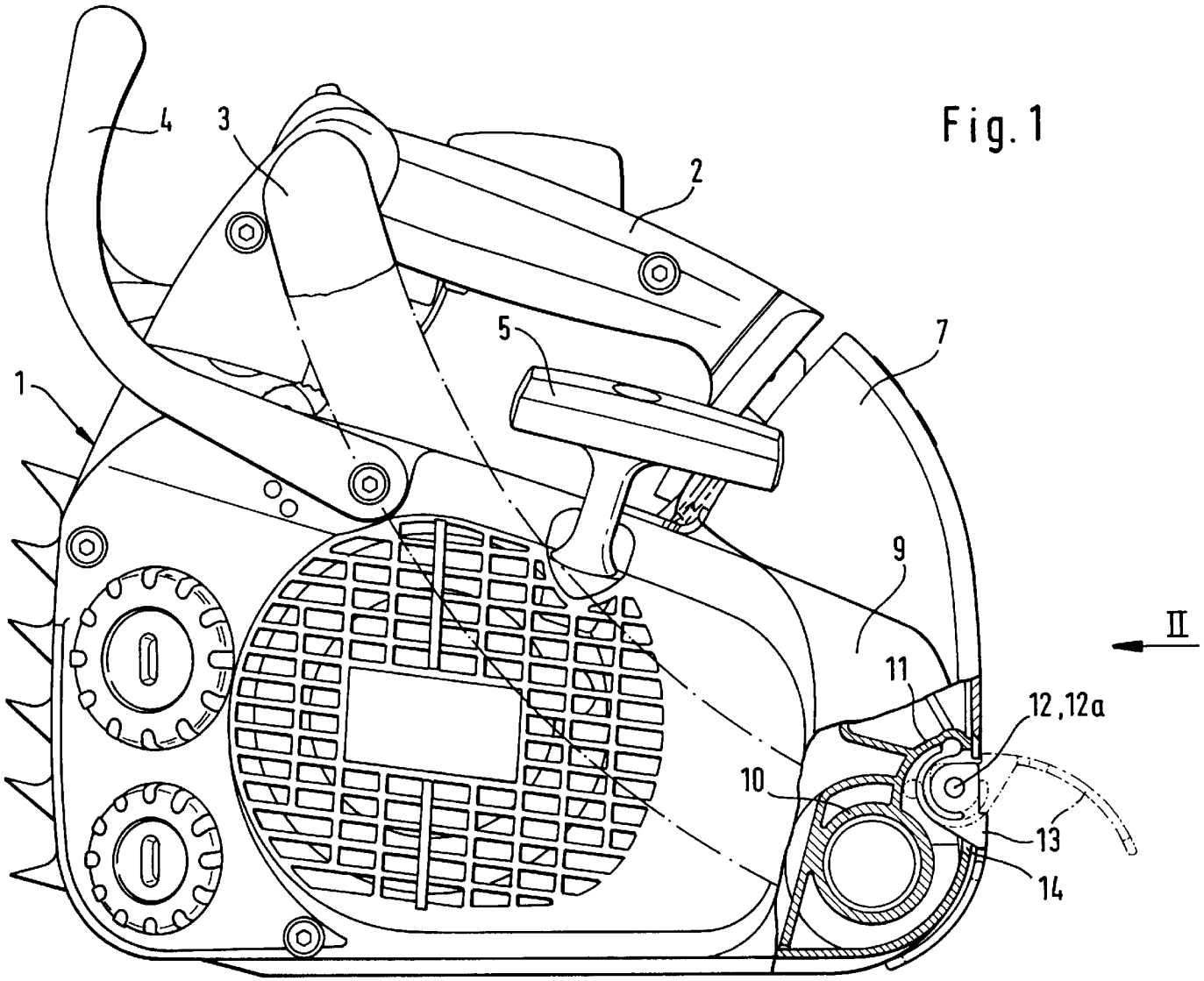
FIG. 1 is a side elevation view of a motor-driven chain saw shown without the guide bar and with a portion of the housing broken away to show the mounting of the safety member.
Figure 2:
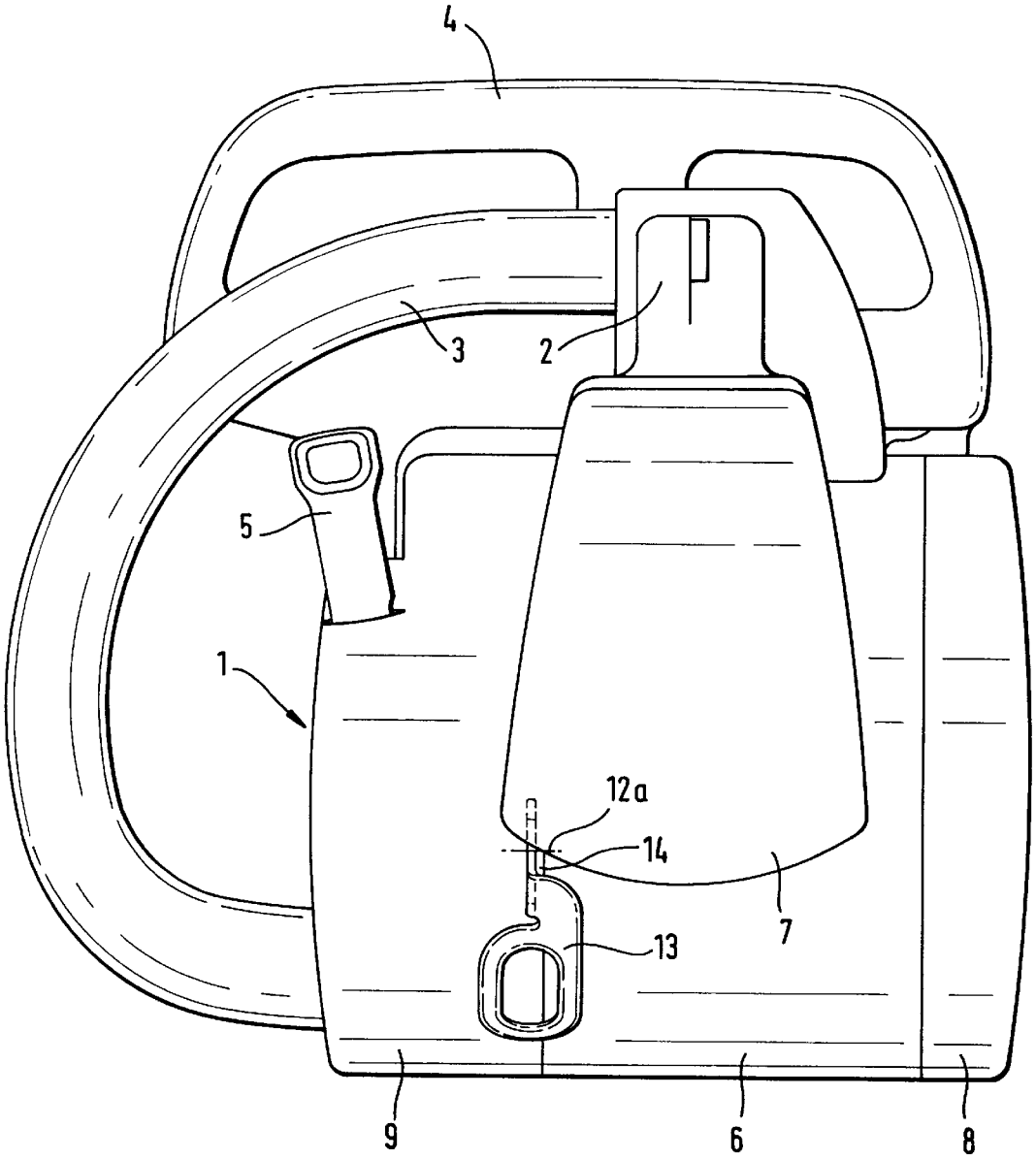
FIG. 2 is an end view of the motor-driven chain saw in the direction of arrow II of FIG. 1.

FIG. 1 shows a side elevation view and FIG. 2 a schematic rear-end view in the direction of arrow II of FIG. 1 of a motor-driven chain saw having a housing 1. A top handle 2 is attached to the housing 1. A side handle 3 extends from the forward end of the top handle 2 arcuately downwardly and toward the rear up to close to the base of the housing and is attached on the left side of the housing. A front hand guard 4 is pivotally journalled on the housing in a manner known per se. The saw chain (not shown) runs about the periphery of the guide bar and is driven by an internal combustion engine mounted in the housing. The engine is started with a rope starter and the handle 5 is attached to the rope of the rope starter.

The housing 1 comprises several parts: a base housing 6 on which a carburetor housing 7 is attached, a sprocket wheel cover 8 for covering the gearing of the saw chain and a housing cover 9 which covers the blower for the engine. The housing cover 9 includes a tube-shaped receptacle 10 in its interior for the side handle 3 as well as reinforcing struts of which a strut 11 is shown in section. The strut 11 extends approximately as a circular arc and almost concentric to an attachment pin 12 which connects the housing cover 9 to the base housing 6. The axis 12*a* of the attachment pin 12 defines the pivot axis for a safety member 13 which is seated in an assembly gap 14. This gap is formed by a recess in the wall of the housing cover 9 which borders directly on the base housing 6.

The safety member 13 is formed as shown in FIGS. 3 to 5 from a flat part which is first stamped out of a metal plate. The safety member is shown enlarged in FIGS. 3 to 5.

FIG. 3 shows the stamped flat part 13*a* as still planar. From the flat part 13*a*, the safety member 13 of FIGS. 4 and 5 is formed by bending along the bending line B. The upper part of the stamped flat part 13*a* defines an attachment portion 15 and the lower part defines an elongated lug 16. The upper and lower portions extend into each other via a connecting section 17. The bending line B extends through the connecting section 17 at which the lug 16 is bent out of the plane of the drawing toward the rear. The opening 16*a* of the lug first lies symmetrically to the extended bending line B and then is symmetrical to the center plane E of the attachment portion 15 (see FIGS. 5 and 7). The center plane E contains the bending line B. During or after bending, the lug 16 is so formed to impart thereto a curvature adapted to the contour of the apparatus housing 1 (see FIGS. 1 and 4).

The attachment portion 15 comprises an attachment section 18 having a bore 19 and a spring-elastic arm 20 which starts from the connecting section 17 (as does the attachment section 18) and extends approximately concentrically to the bore 19. The free end of the arm 20 is expanded and defines a cam 21 having an outline having the shape approximating a circular arc. A sleeve bushing can be seated in the bore 19 so that it cannot separate therefrom and so that it is rotationally movable (not shown).

Figure 6:
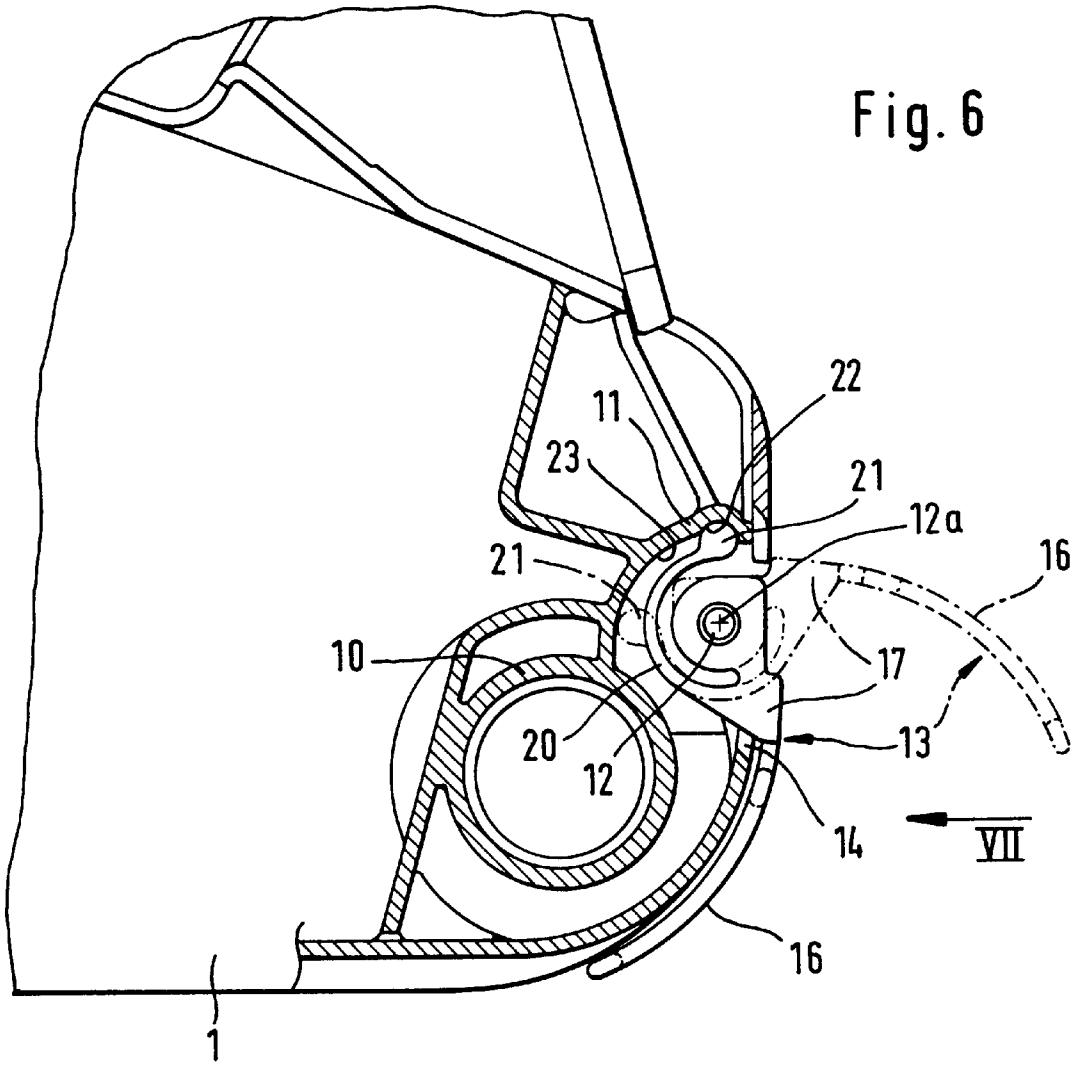
FIG. 6 is a cutout detail view of a portion of FIG. 1 showing the region of the safety member in an enlarged scale; and, FIG. 7 is a view of the safety member as seen in the direction of arrow VII of FIG. 6.
Figure 7:
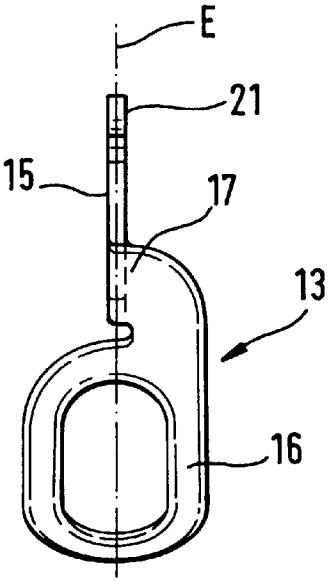

FIG. 6 shows a detailed and expanded view of the rear part of the housing cover 9, in section, with the safety member 13 seated in place. The out-pivoted position of the safety member 13 is shown in phantom outline. In FIG. 7, the safety member is shown in the direction of arrow VII of FIG. 6.

The safety member 13 has the bore 19 (see FIG. 4) in which the sleeve bushing is seated. The safety member 13 is mounted on the attachment pin 12 with the sleeve bearing and is pivotable about the axis 12*a* of the pin 12. The friction is especially low when the safety member 13 is journalled utilizing the sleeve bushing on the attachment pin 12. In the rest position, lug 16 lies tightly against the apparatus housing 1. The lug 16 is adapted with its curvature to the contour of the housing. In this rest position, the cam 21 of the spring-elastic arm 20 is latched in a latch recess 22 which is provided in the reinforcing strut 11 of housing cover 9. This strut 11 defines a guide having a concave support surface 23 on which the latch cam 21 slides when the safety member 13 is pivoted into its operating position. The latch cam 21 lies in frictional contact on the support surface 23 of the reinforcing strut 11 because the arm 20, which supports the latch cam 21, is spring elastic. The safety member 13 therefore is stable also after being pivoted out and is guided during the pivot movement on the support surface 23 as a consequence of the resilient support of the latch cam 21.

Only the narrow assembly gap 14 is needed for the required pivot movement of the safety member 13. The assembly gap 14 is not a disturbance when the safety member 13 is not present. This is especially advantageous for assembly line manufacturing because the housing can always be configured the same independently of whether the housing is used with or without a safety member.

The arrangement of the safety member 13 in the rear lower region of the housing provides an especially advantageous center of gravity position for the situation wherein the apparatus must be held only by the rope fastened to the safety member.

The safety member can also be configured so that it is not only pivotable but can also be journalled in the apparatus housing so that it is, in addition, displaceable. In this embodiment, the attachment portion of the safety member has a slot in lieu of a bore. The attachment portion is then guided in the housing interior on a bolt or pin in such a manner that the safety member is displaceable in correspondence to the slot length and can also be pivoted. A pin-slot connection of this kind makes it possible to pull the safety member from the housing so that a greater spacing of the lug from the housing is provided in the operating position which facilitates introducing a rope or a support hook. The lug can also be so configured in this embodiment that it adapts to the contour of the housing after the safety member is inserted and pivoted.

The safety member is produced from a flat part having a thickness of, for example, approximately 2 mm. For this reason, the flat part does not project disturbingly beyond the housing contour in its rest position in which it lies against the housing. It is, however, possible to provide a recess in the housing wall at the support region of the safety member so that the lug lies recessed in the housing wall in its rest position.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus having a motor-driven work tool, the work apparatus comprising:

a housing;

a handle mounted on said housing for holding and guiding said work apparatus;

a safety member having an attachment portion and a lug portion for receiving and accommodating a safety rope therethrough to facilitate holding said work apparatus;

said safety member being a flat part shaped so that said attachment portion and said lug portion are not coplanar;

said attachment portion and said lug portion conjointly defining a rigid single piece;

a pivot assembly for holding said attachment portion on said housing so as to permit said lug portion to move between a rest position wherein said lug portion is at least partially in contact engagement with said housing and an in-use position wherein said lug portion is displaced away from said housing; and, said pivot assembly defining a pivot axis fixed in said housing and said attachment portion connected to said pivot assembly so as to permit said safety member to pivot about said pivot axis.

2. The portable handheld work apparatus of claim 1, wherein said safety member is a stamped part.

3. The portable handheld work apparatus of claim 1, said attachment portion defining a plane and said lug portion being bent out of said plane at right angles to said attachment portion.

4. The portable handheld work apparatus of claim 3, said housing having a predetermined contour and said lug portion having a contour adapted to the contour of said housing.

5. The portable handheld work apparatus of claim 1, said attachment portion including an attachment section having a bore defining an axis coincident with said pivot axis; and, a spring-elastic arm extending from said attachment section approximately concentric to said bore.

6. The portable handheld work apparatus of claim 5, said spring-elastic arm having a latch cam formed thereon at the end of said arm.

7. The portable handheld work apparatus of claim 6, said housing having a strut for accommodating and guiding said attachment portion.

8. The portable handheld work apparatus of claim 6, said housing having a strut defining a concave support surface for accommodating and guiding said arm with said latch cam being in contact engagement with said support surface; and, said support surface having a latch recess for receiving said latch cam therein to hold said lug portion in one of said positions.

9. The portable handheld work apparatus of claim 3, said attachment portion defining an center plane; and, said lug portion defining an opening symmetrical with respect to said center plane.

10. The portable handheld work apparatus of claim 9, said opening of said lug portion being an elongated opening having a long axis approximately in said center plane.

11. The portable handheld work apparatus of claim 1, said housing having first and second mutually attached housing parts conjointly defining a partition interface; said housing having an assembly gap at said partition interface; and, said safety member with said attachment portion being seated in said assembly gap.

12. The portable handheld work apparatus of claim 11, said housing including an attachment bolt for connecting said first and second housing parts to each other; said pivot assembly including said attachment bolt; said attachment bolt defining said pivot axis; and, said attachment portion being pivotally connected to said attachment bolt so as to pivot about said pivot axis.

13. The portable handheld work apparatus of claim 12, wherein said housing has a lower rearward region; and, said attachment bolt is mounted in the lower rearward region of said housing.

14. The portable handheld work apparatus of claim 12, wherein said pivot assembly further includes a sleeve bearing; said safety member is pivotally mounted on said attachment bolt via said sleeve bearing; and, said attachment portion has a bore formed therein and said sleeve bearing is held in said bore so as to be inseparable from said attachment portion.

15. The portable handheld work apparatus of claim 1, said safety member being made of metal.

16. The portable handheld work apparatus of claim 1, said work apparatus being a motor-driven chain saw.

17. The portable handheld work apparatus of claim 3, said housing having a predetermined curved contour and said lug portion having a curved contour adapted to the contour of said housing so that said lug portion lies in complete contact engagement with said curved contour of said housing when said lug portion is in said rest position.

18. A portable handheld work apparatus having a motor-driven work tool, the work apparatus comprising:

a housing;

a handle mounted on said housing for holding and guiding said work apparatus;

a safety member having an attachment portion and a lug portion for receiving and accommodating a safety rope therethrough to facilitate holding said work apparatus;

said attachment portion and said lug portion conjointly defining a rigid single piece;

means for holding said attachment portion on said housing so as to permit said attachment portion and lug portion to move between a rest position wherein said lug portion is at least partially in contact engagement with said housing and an in-use position wherein said lug portion is displaced away from said housing;

said attachment portion defining a plane and said lug portion being bent out of said plane at right angles to said attachment portion; and, said housing having a predetermined curved contour and said lug portion having a contour adapted to the curved contour of said housing so that said lug portion lies in contact engagement with said curved contour of said housing when said lug portion is in said rest position.

* * * * *